US012790836B1

(12) United States Patent
Jacobs

(10) Patent No.: US 12,790,836 B1
(45) Date of Patent: Nov. 10, 2026

(54) PORTABLE MODULAR CONCRETE SCREED

(71) Applicant: Daniel Jacobs, Daphne, AL (US)

(72) Inventor: Daniel Jacobs, Daphne, AL (US)

( * ) Notice: Subject to any disclaimer, the term of this patent is extended or adjusted under 35 U.S.C. 154(b) by 279 days.

(21) Appl. No.: 18/775,155

(22) Filed: Jul. 17, 2024

(51) Int. Cl.
*E04F 21/24* (2006.01)
*E01C 19/44* (2006.01)

(52) U.S. Cl.
CPC ..... *E04F 21/241* (2013.01); *E01C 19/44* (2013.01)

(58) Field of Classification Search
CPC ..... E04F 21/241; E01C 19/44
USPC ..... 404/72, 75, 118–121
See application file for complete search history.

(56) References Cited

U.S. PATENT DOCUMENTS 3,082,460 A 3/1963 Haivala
4,427,358 A 1/1984 Stilwell
4,611,363 A * 9/1986 Samuelsson ..... A47L 1/06 15/245
4,931,008 A 6/1990 Morrison
5,468,095 A * 11/1995 Dawson ..... B28B 1/29 404/118
8,622,649 B1 * 1/2014 Peeroo ..... E01C 19/15 404/119
11,753,779 B2 9/2023 Ulmer et al.
2002/0106244 A1 8/2002 Baker
2012/0141204 A1 * 6/2012 Crouch ..... E01C 19/44 404/118
2023/0128185 A1 * 4/2023 Mcintosh ..... E01C 19/44 404/118

* cited by examiner

*Primary Examiner* — Raymond W Addie
(74) *Attorney, Agent, or Firm* — George L Williamson

(57) ABSTRACT

Method and apparatus for a portable modular screed system having individual sections which can be joined together in a series so as to form an elongated screed made up of shorter modules so that the elongated screed can be easily assembled and disassembled so that it can be moved from one jobsite to another. The modules are sized so that when joined together the overall length of the assembled screed would always be measured in three-foot increments. The modules are joined together using button clips in association with an insert which insert is welded to the end of the module. The cross-sectional design of the present invention is angled at a specific slope and shape allowing it to easily cut through and separate the concrete material that is being screeded.

15 Claims, 2 Drawing Sheets

PORTABLE MODULAR CONCRETE SCREED

PRIOR ART

Devices relevant to the present invention have been described in the related art; however, none of the related art devices disclose the unique features of the present invention.

In U.S. Patent Application Publication No. 2002/0106244, dated Aug. 8, 2002, Baker disclosed a screed plate interlock. In U.S. Pat. No. 4,427,358, dated Jan. 24, 1984, Stilwell disclosed a sectional concrete screed machine. In U.S. Pat. No. 4,931,008, dated Jun. 5, 1990, Morrison disclosed a quick disassembly screed construction. In U.S. Pat. No. 3,082,460, dated Mar. 26, 1963, Haivala disclosed a concrete working tool. In U.S. Pat. No. 11,753,779, dated Sep. 12, 2023, Ulmer, et al., disclosed a modular concrete screed system.

While these devices may be suitable for the purposes for which they were designed, they would not be as suitable for the purposes of the present invention as hereinafter described. As will be shown by way of explanation and drawings, the present invention works in a novel manner and differently from the related art.

BACKGROUND OF THE INVENTION

The present invention relates generally concrete equipment used for forming, grading and screeding concrete and, more particularly, is concerned with a modular sectional, portable concrete screed.

SUMMARY OF THE INVENTION

The present invention discloses a portable modular screed system having individual modules or sections which can be joined together in a series so as to form an elongated screed made up of shorter modules so that the elongated screed can be easily assembled and disassembled so that it can be moved from one jobsite to another making the present invention easily adaptable to one jobsite versus another jobsite based on the needs of the user. Furthermore, the present invention can be easily stored when it is disassembled. The modules are joined together so that the overall length of the assembled screed would always be measured in three-foot increments. It is intended that the screed of the present invention would be made of aluminum to be lightweight with the modules being joined together using button clips in association with an insert which insert is welded to the end of the module. Furthermore, the cross-sectional design of the present invention is angled at a specific slope and shape allowing it to easily cut through and separate the concrete material that is being screeded.

An object of the present invention is to provide a modular concrete screed system. A further object of the present invention is to provide a portable screed system. A further object of the present invention is to provide a concrete screed system that can easily be moved from one jobsite to another jobsite. A further object of the present invention is to provide a concrete screed that is sectionalized into segments having three-foot lengths. A further object of the present invention is to provide a concrete screed which can be easily operated by a user. A further object of the present invention is to provide a concrete screed system that can be relatively easily and inexpensively manufactured.

The foregoing and other objects and advantages will appear from the description to follow. In the description reference is made to the accompanying drawings, which form a part hereof, and which are shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF DRAWINGS

In order that the invention may be more fully understood, it will now be described, by way of example, with reference to the accompanying drawings in which.

DETAILED DESCRIPTION OF THE INVENTION

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. Figures through 6 illustrate the present invention wherein a portable modular concrete screed system is disclosed, and which is generally indicated by reference number 10.

Figure 1:
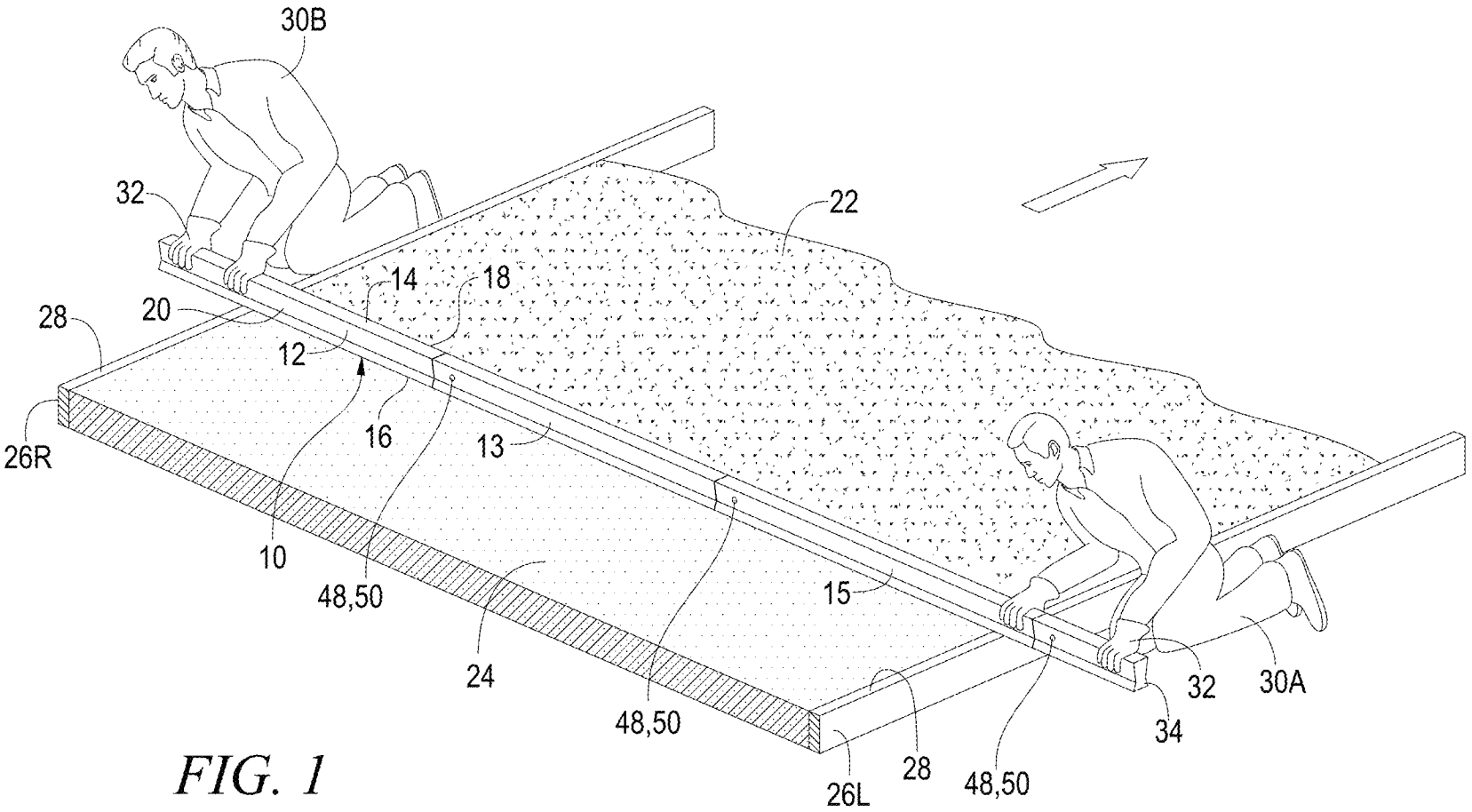
FIG. 1 is a perspective view of the present invention shown in operation.

Turning to FIG. 1, therein is shown the present invention 10 having a plurality of modules or sections 12, 13, and 15 joined in a series wherein each module has a top 14, bottom 16, front 18, and rear 20 wherein the screed of the present invention 10 is used to level and smooth freshly poured, unfinished concrete 22 by moving the present invention 10 in the direction indicated by the arrow so that as the screed 10 is advanced along the poured, unfinished concrete 22, the concrete to the rear of the screed 10 is shaped into finished concrete 24. Also shown are concrete forms 26R and 26L containing the concrete so that the bottom 16 of the screed is placed on and moved along the top 28 of the left and right forms 26L, 26R as the present invention is being held in the hands 32 of the users 30A and 30B wherein one user is on each end of the present invention 10. Also shown is a removable cap 34 shown on one end of the present invention 10 which will be explained in more detail hereinafter. The screed of the present invention 10 is also closed on its first end opposite to cap 34 which closure could be done permanently or removably. Also shown is the male button 48 of the button clip protruding from its corresponding aperture 50.

The concrete forms 26L, 26R hold the poured, unfinished concrete 22 within the space provided inside the form as the concrete is finished to form the concrete slab 24 having a user preferred size and shape.

It is well known that a concrete screed assembly is pulled forwardly along the concrete area to screed the poured, unfinished concrete 22 into the shape of the form. As the concrete screed assembly of the present invention 10 is advanced forwardly to grade the surface of the concrete 22, the excess concrete is directed forwardly ahead of the present invention 10. It is also well known that a concrete screed can be used to remove excess concrete material on a jobsite. For example, the present invention 10 can remove excess concrete from an area where the poured, unfinished concrete 22 is above a desired grade level wherein the desired grade level is defined by the upper or top edges 28 of the forms 26L, 26R. Preferably the present invention 10 will rest on the upper surface 28 of the forms 26L, 26R. Also, the present invention 10 can be used to transfer concrete from one area of the jobsite to another area of the jobsite simply by moving the present invention 10 along the top 28 of the left and right forms 26L, 26R. It is well known that screeding is a process in concrete work where freshly poured concrete is shaped into a slab having a smooth upper surface/layer before the surface is finished and is the first step in the finishing process and helps fill in uneven gaps or depressions (low spots) in the concrete surface while removing uneven high spots.

Figure 2:
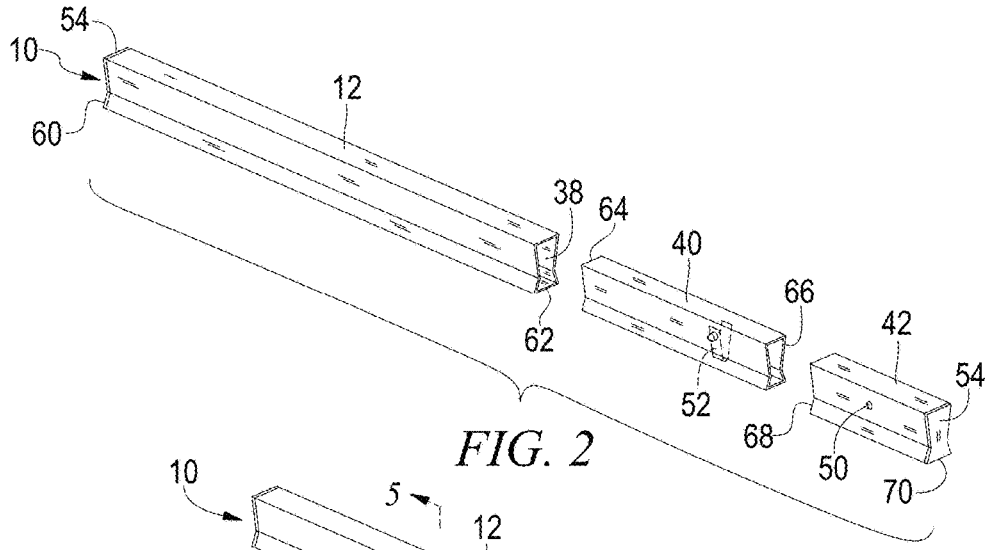
FIG. 2 is an exploded perspective view of a section of the present invention.

Turning to FIG. 2, therein is shown the present invention 10 having a first modular screed component 12 which is hollow as shown at 38 for receiving one end of a male insert 40 into the bore of the first screed section 12 so that a cap 42 also being hollow can be slidingly placed over the opposite end of the insert 40. The screed section 12 is closed on its first end opposite to the insert 40 to prevent foreign matter such as concrete and debris from entering the hollow area 38 so as to reduce weight as similarly done with closed end 54. The insert 40 being hollow has a button clip 52 inside wherein the male button 48 protrudes through its corresponding aperture 50 being slightly smaller to slide into module 12 and cap 42. Also shown is end cap 42 being hollow with aperture 50 and closed end 54 being slightly larger than insert 40 to slide over the insert 40. Both insert 40 and cap 42 are similarly sized and shaped to fit and cooperate with the module 12. Screed section 12 has first and second ends 60, 62 with the first end being closed at 54, insert 40 has first and second ends 64, 66, and cap 42 has first and second ends 68, 70.

Figure 3:
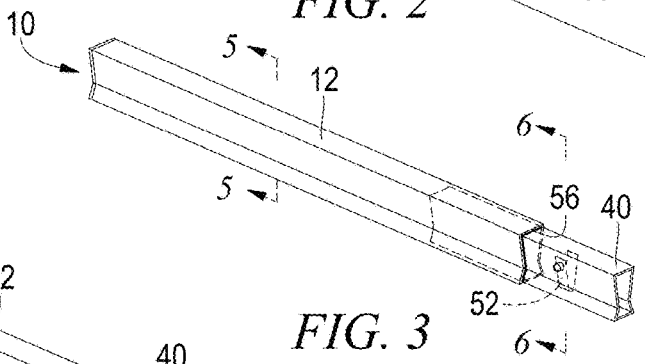
FIG. 3 is a perspective view of a portion of the present invention simple.

Turning to FIG. 3, therein is shown a first modular section 12 of the screed component of the present invention 10 having the insert 40 placed into the bore of the section 12 and being secured by welding as illustrated at 56. Also note the aperture 50 and male button 48 of button clip 52.

Figure 4:
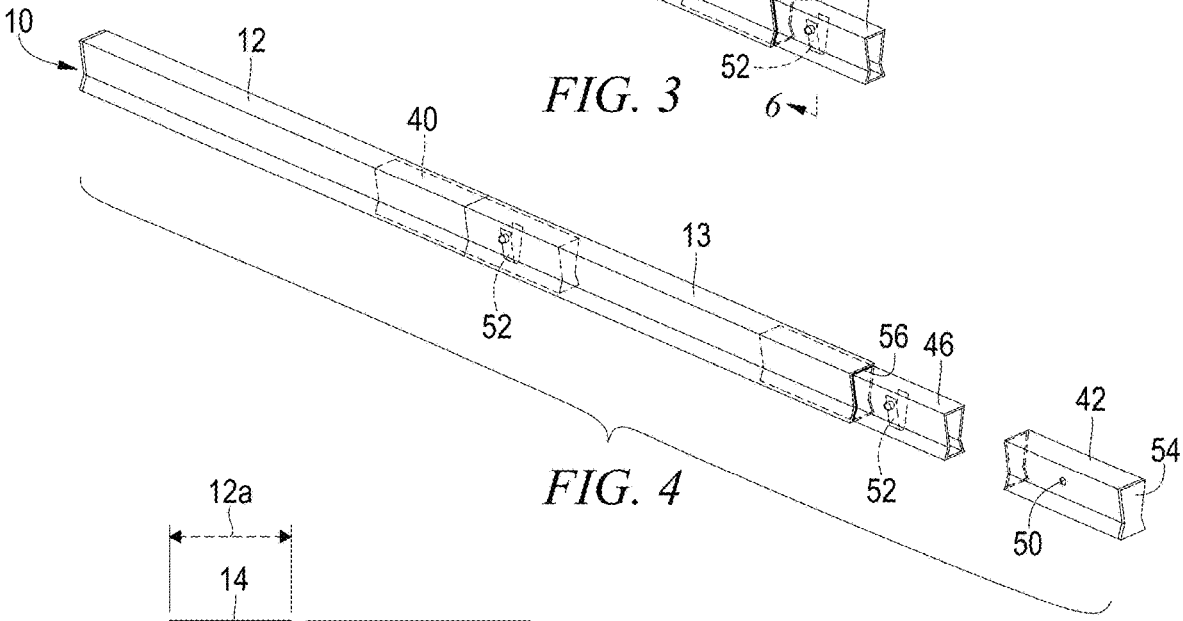
FIG. 4 is a partially exploded perspective view of the present invention assembled.

Turning to FIG. 4, therein is shown a first modular section 12 of the present invention 10 having a first insert 40 placed inside it and having a second modular section 13 placed over an end of the first insert 40 with module 44 having a second insert 46 placed inside so that the cap 42 is then placed on the end of the succeeding second section 13 of the screed of the present invention 10. The modules 12, 13, 15 etc. are sized so that when joined together the overall length of the assembled screed including an insert 40, 46, etc. and cap 34, 42, etc. would always be measured in three-foot increments.

Figure 5:
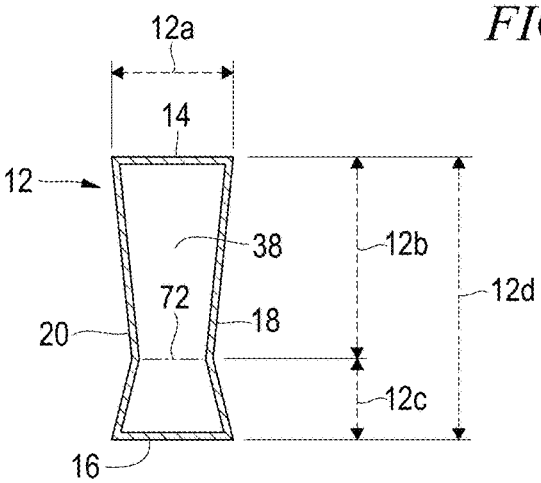
FIG. 5 is a cross-sectional view of the present invention taken from FIG. 3 as indicated.

Turning to FIG. 5, therein is shown the cross-sectional area of the module 12 of the present invention 10 showing bore 38. The module 12 is expected to be made of aluminum. The approximate cross-sectional dimensions of a module 12 follow: 12*a* equal 1.5 inch; 12*b* equal 2.5 inch upper portion; 12*c* equal 1.0 inch lower portion; and 12*d* equal 3.5 inch. Each module 12 would be about 30 inch long; each insert 40 would be about one foot long so that about 6 inch would protrude from an end of a module 12; and each cap 34 would be about 6 inch long so that the overall length of an assembled single screed component would be about three feet. In geometrical terms, the module 12 cross-sectional shape is complex in that it is composed of a pair of isosceles trapezoids sharing a common side 72 with the common side having a width of approximately 1 inch and being shown in phantom line at 72. One could call this a complex geometrical shape a double trapezoid or opposed trapezoids sharing a common side. The shape of the module 12 makes it longer on its upper portion (about 2.5 inch high) making it easy to be grasped in the hand 32 of a user 30A, 30B, while the shape of the lower portion (about 1 inch high) helps it cut through, separate and screed the unfinished concrete 22 as best shown in FIG. 1 and FIG. 5 where its cross-section is illustrated.

Figure 6:
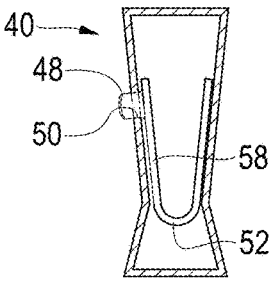
FIG. 6 is a cross-sectional view of the present invention taken from FIG. 3 as indicated.

Turning to FIG. 6, therein is shown a cross-section of the insert 40 illustrating its unusual shape and its cross-sectional area that is longer at its upper portion and shorter at its lower portion so that a user can easily grasp the upper portion of the present invention 10. Also shown is the button clip 52 fastener which can be described as a single button v-shaped spring clip having a male push button 48 in aperture 50 having spring arm 58. Button clips 52 are useful for easily fastening and securing two components together and work by a user placing a finger on the male push button 48 and compressing it so as to compress its spring arm and then releasing it so that it snaps into a corresponding hole on the other component so as to secure the components together as the two components are telescopically slidably operated relative to each other. Button clips 52 make it easy to connect and disconnect components to each other.

In operation, as shown in FIGS. 1-6, the present invention 10 is a modular screed wherein the three individual modules 12, 13, or 15 can be joined together one after the other in a series to form a user selected length of screed. FIG. 1 illustrates three modules 12, 13, and 15 being joined together in a series to form a longer screed with an end cap 42 on its end which overall length is user selected for the size and needs of the specific job site so that the screed of the present invention 10 will cooperate with the forms 26L, 26R of the specific job site. FIG. 2 illustrates one module 12 having an insert 46 with an end cap 42 on its end. FIG. 4 illustrates two modules 12 and 13 being joined together in a series to form a longer screed having an insert 46 with an end cap 42 on its end.

By way of summary and by reference to FIGS. 1-6, the present invention 10 discloses how to assemble a concrete screed 10 by forming a concrete screed using a series of adjoining elongated screed sections 12, 13, 15 interconnected in an end-to-end relationship (see FIGS. 1 and 4) each of the elongated screed sections having first 60 and second 62 ends, wherein each of the elongated screed sections is hollow having an interior 38 therein, a first 12 elongated screed section of the series being closed 54 on the first end 60 to prevent foreign matter from entering therein and providing an insert 40 having first 64 and second 66 ends, the insert being similarly sized and shaped as the elongated screed section, the first end of the insert being slidably inserted into the interior of the second end of the elongated screen section and the second end of the insert is a free end (see FIG. 3), wherein the insert section is hollow having an interior therein (see FIG. 3), then attaching the insert to the elongated screed section at 56 and removably attaching each the first ends of each adjoining elongated screed section to each the free second end of each insert 40 using a fastener 52 and providing a cap 42 having first 68 and second 70 ends being similarly sized and shaped as the free second end of the insert, the cap being hollow having an interior therein, the cap being open on the first end and closed on the second end at 54, the open first end of the cap being slidably disposed over the second free end of a last insert of the series (see FIG. 4) and removably attaching the cap to the last insert of the series using a fastener 52. Wherein the insert 40 is fixedly attached to the elongated screed section 12 by at least one weld 56 and wherein a cross-sectional view of each the elongated screed section resembles a trapezoid (see FIG. 5) wherein each of the elongated screed sections has an upper portion and a lower portion, the upper portion being longer than the lower portion for being grasped in a hand of a user (see FIGS. 1 and 5).

The invention claimed is:

1. A concrete screed, comprising:

a) an elongated screed section having first and second ends, said elongated screed section being hollow having an interior therein, said elongated screed section being closed on said first end to prevent foreign matter from entering therein;

b) an insert having first and second ends, said insert being similarly sized and shaped as said elongated screed section having first and second ends, wherein said first end of said insert is inserted into said interior of said second end of said elongated screed section and said second end of said insert is a free end, said insert section being hollow having an interior therein;

c) wherein said insert is fixedly attached to said elongated screed section;

d) a cap having first and second ends, said cap being similarly sized and shaped as said free end of said insert, said cap being hollow having an interior therein, said cap being open on said first end and closed on said second end, said open first end of said cap being slidably disposed over said second free end of said insert; and e) wherein said cap is removably attached to said insert using a fastener.

2. The concrete screed of claim 1, wherein said insert is fixedly attached to said second end of said elongated screed section by at least one weld.

3. The concrete screed of claim 1, wherein said fastener is a button clip.

4. The concrete screed of claim 1, wherein a cross-sectional view of said elongated screed section resembles a trapezoid.

5. The concrete screed of claim 4, wherein said elongated screed section has an upper portion and a lower portion, said upper portion being longer than said lower portion for being grasped in a hand of a user.

6. A system for a concrete screed, comprising:

a) a concrete screed comprising a series of adjoining elongated screed sections interconnected in an end-to-end relationship each said elongated screed section having first and second ends, wherein each said elongated screed section is hollow having an interior therein, a first said elongated screed section of said series being closed on said first end to prevent foreign matter from entering therein;

b) an insert having first and second ends, said insert being similarly sized and shaped as said elongated screed section, said first end of said insert being slidably inserted into said interior of said second end of said elongated screed section and said second end of said insert is a free end, wherein said insert section is hollow having an interior therein;

c) wherein said insert is fixedly attached to said elongated screed section;

d) wherein each said first end of each adjoining said elongated screed section is removably attached to each said free second end of each said insert using a fastener;

e) a cap having first and second ends and being similarly sized and shaped as said free second end of said insert, said cap being hollow having an interior therein, said cap being open on said first end and closed on said second end, said open first end of said cap being slidably disposed over said second free end of a last said insert of said series; and f) wherein said cap is removably attached to said last insert using a fastener.

7. The concrete screed of claim 6, wherein said fastener is a button clip.

8. The concrete screed of claim 6, wherein said insert is fixedly attached to said elongated screed section by at least one weld.

9. The concrete screed of claim 6, wherein a cross-sectional view of each said elongated screed section resembles a trapezoid.

10. The concrete screed of claim 9, wherein each said elongated screed section has an upper portion and a lower portion, said upper portion being longer than said lower portion for being grasped in a hand of a user.

11. A method of assembling a concrete screed, comprising the steps of:

a) forming a concrete screed comprising a series of adjoining elongated screed sections interconnected in an end-to-end relationship each said elongated screed section having first and second ends, wherein each said elongated screed section is hollow having an interior therein, a first said elongated screed section of said series being closed on said first end to prevent foreign matter from entering therein;

b) providing an insert having first and second ends, said insert being similarly sized and shaped as said elongated screed section, said first end of said insert being slidably inserted into said interior of said second end of said elongated screed section and said second end of said insert is a free end, wherein said insert section is hollow having an interior therein;

c) attaching said insert to said elongated screed section;

d) removably attaching each said first end of each adjoining said elongated screed section to each said free second end of each said insert using a fastener;

e) providing a cap having first and second ends and being similarly sized and shaped as said free second end of said insert, said cap being hollow having an interior therein, said cap beings open on said first end and closed on said second end, said open first end of said cap being slidably disposed over said second free end of a last said insert of said series; and f) removably attaching said cap to said last insert of said series using a fastener.

12. The method of claim 11, wherein said fastener is a button clip.

13. The method of claim 11, wherein said insert is fixedly attached to said elongated screed section by at least one weld.

14. The method of claim 11, wherein a cross-sectional view of each said elongated screed section resembles a trapezoid.

15. The method of claim 14, wherein each said elongated screed section has an upper portion and a lower portion, said upper portion being longer than said lower portion for being grasped in a hand of a user.

* * * * *